US008469763B2

(12) United States Patent
Neate et al.

(10) Patent No.: US 8,469,763 B2
(45) Date of Patent: Jun. 25, 2013

(54) PLASMA CRUCIBLE SEALING

(75) Inventors: Andrew Simon Neate, Aylesbury (GB); Barry Preston, Melton Mowbray (GB); Edwin Charles Odell, Leicester (GB); Amjid Sadiq, Aylesbury (GB); Hussein Sonde, Oadby (GB)

(73) Assignee: Ceravision Limited, Milton Keynes (GB)

( * ) Notice: Subject to any disclaimer, the term of this patent is extended or adjusted under 35 U.S.C. 154(b) by 0 days.

(21) Appl. No.: 13/202,654

(22) PCT Filed: Feb. 22, 2010

(86) PCT No.: PCT/GB2010/000313

§ 371 (c)(1),
(2), (4) Date: Jan. 5, 2012

(87) PCT Pub. No.: WO2010/094938

PCT Pub. Date: Aug. 26, 2010

(65) Prior Publication Data

US 2012/0091892 A1 Apr. 19, 2012

Related U.S. Application Data

(60) Provisional application No. 61/209,598, filed on Mar. 9, 2009.

(30) Foreign Application Priority Data

Feb. 23, 2009 (GB) ..... 0903017.2

(51) Int. Cl.
*H01J 9/00* (2006.01)
*H01J 9/40* (2006.01)
*H01J 9/395* (2006.01)

(52) U.S. Cl.
USPC ..... 445/38; 445/16; 445/22; 445/26; 445/42; 445/43

(58) Field of Classification Search
None
See application file for complete search history.

(56) References Cited

U.S. PATENT DOCUMENTS

| | | | | |
|---|---|---|---|---|
| 2002/0000779 | A1 * | 1/2002 | Anders | 315/111.21 |
| 2005/0057158 | A1 | 3/2005 | Chang et al. | |
| 2007/0109069 | A1 | 5/2007 | Espiau | |

FOREIGN PATENT DOCUMENTS

| | | | |
|---|---|---|---|
| EP | 0 786 797 | | 7/1997 |
| JP | 05-205641 | * | 8/1993 |
| JP | 05 205641 | | 8/1993 |
| WO | WO 2008/139186 | | 11/2008 |

* cited by examiner

*Primary Examiner* — Ashok Patel
(74) *Attorney, Agent, or Firm* — Bay State IP, LLC

(57) ABSTRACT

A plasma crucible has a through bore and two tubes butt scaled on to the end faces of the crucible. One of the tubes is closed prior to the filling of the crucible. The tube is tipped off and worked in a glass lathe to form it to have a flat end. After evacuation, dosing and gas fill, the other tube is tipped off in the similar manner.

20 Claims, 5 Drawing Sheets

PLASMA CRUCIBLE SEALING

CROSS REFERENCE TO RELATED APPLICATION

This application is for entry into the U.S. National Phase under §371 for International Application No. PCT/GB2010/000313 having an international filing date of Feb. 22, 2010, and from which priority is claimed under all applicable sections of Title 35 of the United States Code including, but not limited to, Sections 120, 363 and 365(c), and which in turn claims priority under 35 USC 119 to United Kingdom Patent Application No. 0903017.2 filed on Feb. 23, 2009 and to U.S. Patent Application No. 61/209,598 filed on Mar. 9, 2009.

BACKGROUND OF THE INVENTION

1. Field of the Invention

The present invention relates to plasma crucible sealing and a sealed plasma crucible.

2. Description of the Related Art

In our PCT/GB2008/003829, we have described and claimed a light source to be powered by microwave energy, the source having:

- a solid plasma crucible of material which is lucent for exit of light therefrom, the plasma crucible having a sealed void in the plasma crucible,
- a Faraday cage surrounding the plasma crucible, the cage being at least partially light transmitting for light exit from the plasma crucible, whilst being microwave enclosing,
- a fill in the void of material excitable by microwave energy to form a light emitting plasma therein, and
- an antenna arranged within the plasma crucible for transmitting plasma-inducing microwave energy to the fill, the antenna having:
  - a connection extending outside the plasma crucible for coupling to a source of microwave energy;

the arrangement being such that light from a plasma in the void can pass through the plasma crucible and radiate from it via the cage.

In that application, we gave the following definitions:

"lucent" means that the material, of which the item described as lucent, is transparent or translucent;

"plasma crucible" means a closed body [for] enclosing a plasma, the latter being in the void when the void's fill is excited by microwave energy from the antenna. In this application we continue to use the definition, with the proviso that it is in the context of sealing a crucible, which does not contain a plasma during sealing. Accordingly, as used herein, the definition includes the word "for".

In this application, we define:

"filled plasma crucible" to mean a lucent plasma crucible having sealed in its void an excitable, light emitting fill.

A filled plasma crucible as such may have an antenna fixedly sealed within the crucible, possibly in the void, or a re-entrant in the crucible, into which an antenna is inserted for use of the crucible.

SUMMARY OF THE INVENTION

The object of the present invention is to provide an improved method of sealing a filled plasma crucible.

According to one aspect of the invention there is provided a method of sealing a filled plasma crucible consisting in the steps of:

- providing a plasma crucible of lucent material having an open void, the void having a mouth;
- providing a tube of extending away from the mouth of the crucible, the tube being hermetically sealed to the crucible;
- inserting excitable material into the void via the tube;
- evacuating the void via the tube;
- introducing an inert gas into the void via the tube; and
- sealing the void, enclosing the excitable material and the inert gas, by sealing the tube at or close to the mouth.

Preferably the sealing step includes collapse and fusing of the tube.

Whilst in certain embodiments, the plug now described will not be used, in other embodiments:

- the void is provided with a stop for a plug at the mouth of the void and
- a plug is positioned in the mouth against the stop via the tube, the plug and the mouth being complementarily shaped for location of the plug for its sealing in the mouth and provided with clearance and/or local shaping to allow gas flow from and to the void.

In another alternative, the plug can be sealed against a flat face of the crucible.

Where a plug is not used, the tube can be positioned on and fused onto a face of the crucible. Alternatively, the tube can be positioned in and fused into a counterbore in the face of the crucible at the mouth of the void.

In some uses of the filled plasma crucible, it will be supported via the tube which will remain extending from the crucible. In other uses, the tube will be removed close to the seal and the crucible supported from its body.

According to another aspect of the invention, there is provided a filled plasma crucible having:

a tube or a vestige thereof extending from the sealed mouth.

A second tube or a vestige thereof extending from the sealed mouth at the opposite face of the crucible.

Where the crucible is to be of quartz, whilst moulding and sintering is possible for forming the crucible and the tube; conveniently the crucible is formed from a block of quartz, having the void machined in it, and the quartz tube is sealed to the block by heating and fusing. Final sealing of this crucible is conveniently completed by tipping off, that is local heating of the tube close to the crucible, allowing atmospheric pressure to collapse it when softened, removing the heat and drawing the remaining tube away.

To clean up the void after drilling, in particular to remove particulate impurities liable to interfere with the plasma discharge, the void is preferably ultrasonically cleaned and then flame polished to enhance transparency and inhibit crack propagation. To facilitate this, the void is preferably bored right through the crucible and then sealed off at its end opposite the tube after polishing.

A plug may be fused into the mouth or at least retained by the collapsed and sealed tube.

Fusing of the quartz tube is readily performed using conventional flames or argon plasma flames.

Normally the crucible, the tube and the plug, where provided, will be of the same material. Where the material is polycrystalline ceramic, this is more readily moulded in green state and fired to finished state. It is less easy to seal this crucible by collapse and fusing of the tube and a plug is more likely to be used. A frit material can be provided at the interface between the plug and the crucible to provide a fusible, sealing interface between the two. Conveniently the frit is provided initially on the plug. The frit can be readily fused by use of a laser, which can be arranged to pass through the ceramic material to focus on the frit material.

Where a plug is to be used, it and/or the mouth of the void are shaped with a step, whereby the plug is readily placed in position with the step providing the stop. The plug can be thin with respect to its diameter—it and the mouth normally being of circular cross-section—but it will normally be of appreciable thickness so as to be unable to turn out of alignment within the tube whilst being positioned. Alternatively to a stepped configuration, the mouth and plug can be tapered, the taper providing the seat. Such a configuration is satisfactory for evacuation, but can provide self-sealing against inert gas introduction. For this a specific gas passage can be provided in the form or a shallow flat or groove along the plug. It may be desirable to provide such a flat or groove even with the stepped configuration, in particular to avoid premature closure at the step against inert gas introduction.

Conveniently, and in particular to enhance predictable microwave resonance in the crucible, the plug is dimensioned to be locally flush with the plasma crucible when positioned on the stop. Nevertheless it can be envisaged that fusing for sealing may be easier if the plug extends into the tube. Further sealing of the tube against the wall of the tube renders condensation space for the excitable material more predictable. Considerations here being that the vestige of the tube is likely to provide a cold spot at which the excitable material is likely to condense and that it is important for the material to have a surface in ready communication with the void, whereby the material can evaporate into the void to participate in the plasma.

Preferably, in use, the vestige of the tube is used as a duct via which an electric field pulse can be introduced into the crucible for initiating discharge in it.

Normally the void will be positioned on a central axis of the crucible.

For light emitting use, the filled plasma crucible will normally have a re-entrant occupied by an antenna. The re-entrant can be on the central axis of the crucible, opposite from the plug or indeed in the plug. In either of these cases the void and the re-entrant will normally be co-axial. Alternatively the antenna re-entrant can be off-set to one side of the void.

BRIEF DESCRIPTION OF THE DRAWINGS

To help understanding of the invention, a number of specific embodiments thereof will now be described by way of example and with reference to the accompanying drawings, in which.

DETAILED DESCRIPTION OF THE PREFERRED EMBODIMENTS

Figure 1:
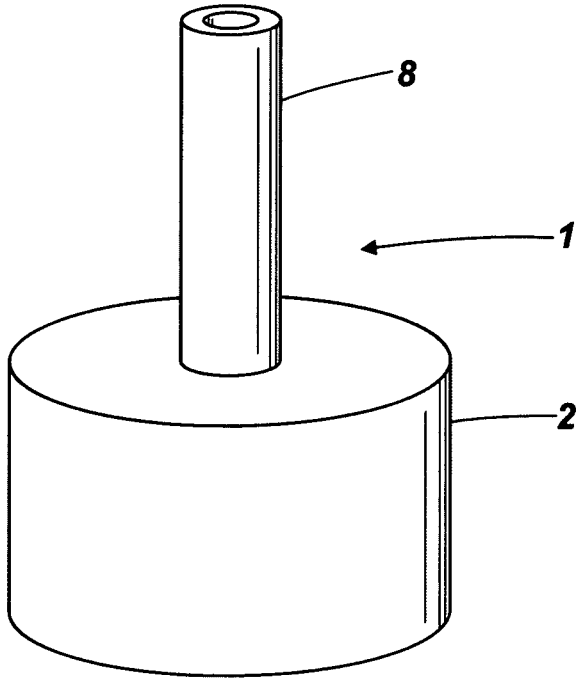
FIG. 1 is a perspective view of a crucible and tube prepared for sealing in accordance with the invention.
Figure 2:
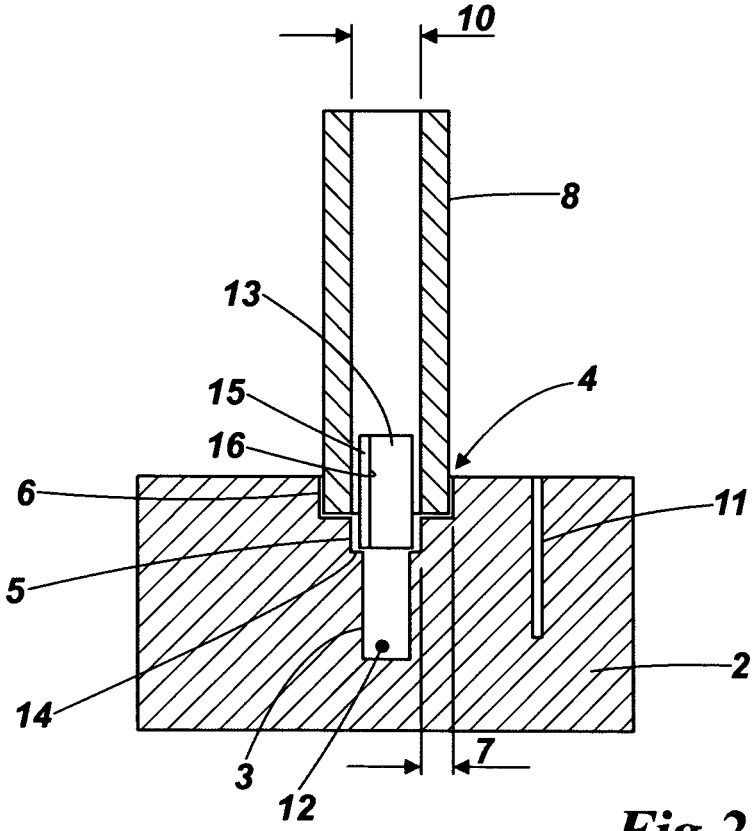
FIG. 2 is a cross-sectional side view of the crucible and tube of FIG. 1.
Figure 3:
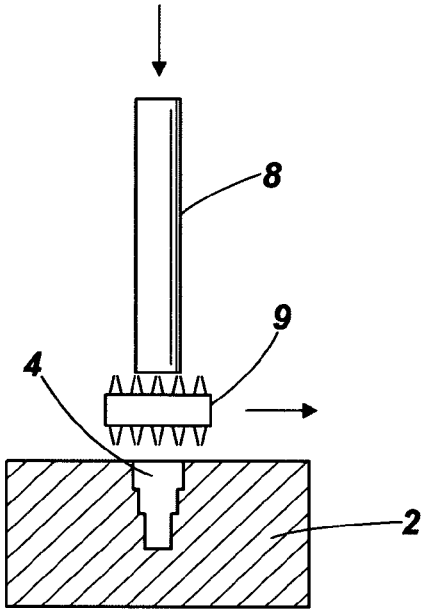
FIG. 3 is a side view of the crucible and tube being heated for sealing together.

Referring to FIGS. 1 to 6, a quartz crucible 1 to be filled with noble gas and dosed with excitable plasma material is formed as a thick disc/short circular cylinder 2 defining the effective dimensions of the finished crucible and having a central void 3 opening on one end of the crucible at a mouth 4. The mouth is in the form of a pair of counterbores 5,6, the inner one 5 being deeper than the outer one 6, which provides an appreciable increment 7 in radius. A tube 8 having a wall thickness nominally the same as the increment is attached to the cylinder by heating via a double-sided burner 9. The heating and the insertion is controlled to ensure that a hermetic seal is created between the cylinder and the tube, with minimum obstruction of the full internal bore 10 of the tube continuing past the tube into the inner counterbore 5. From the same end of the crucible as the tube extends, an antenna re-entrant 11 extends into the cylinder at a radius equal to one quarter of the latter's diameter.

A pellet 12 of excitable material is dropped into the void via that the tube, followed by a circular cylindrical plug 13. This is of a clearance diameter in the bore 10 and comes to rest on the step 14 between the counter bore 5 and the void 3. To provide for initial gas communication from the void past the plug, this has a shallow groove 15 along its length, which continues in its inner face 16 beyond the radial extent of the step.

The distal end of the tube is connected to vacuum pump (not shown as such) via a Y fitting having a first valve and union 17 for connection to the pump and a second valve and union 18 for connection to a source of noble gas at a controlled, sub-atmospheric pressure (the source as such also not shown). The void is evacuated via the valve 17, which is closed after evacuation. The void is then charged with noble gas via the valve 18, which again is closed after charging. The gas is able to reach the void via the groove 15.

The final stage in formation of a filled plasma crucible is heating of the tube via a burner 19. The heating is continued until the quartz material of the tube softens and the excess of atmospheric pressure over the internal pressure of the noble gas causes the tube to collapse on itself. The plug seated on the step 14 extends slightly into the tube 8 and past the external face of the end of the crucible, as is shown by the dimension 20. The heating is made just beyond this dimension, whereby as the tube collapses, it shrinks onto the outer end corner 21 of the plug. Thus the void is double sealed in that any vestigial space 22 at the end of the plug is sealed from the void at the corner 21 and a complete closure of the tube is achieved at the "tip off" 23 of the tube, where the distal end piece of the tube is drawn away from the crucible after collapse of the tube.

Figure 6:
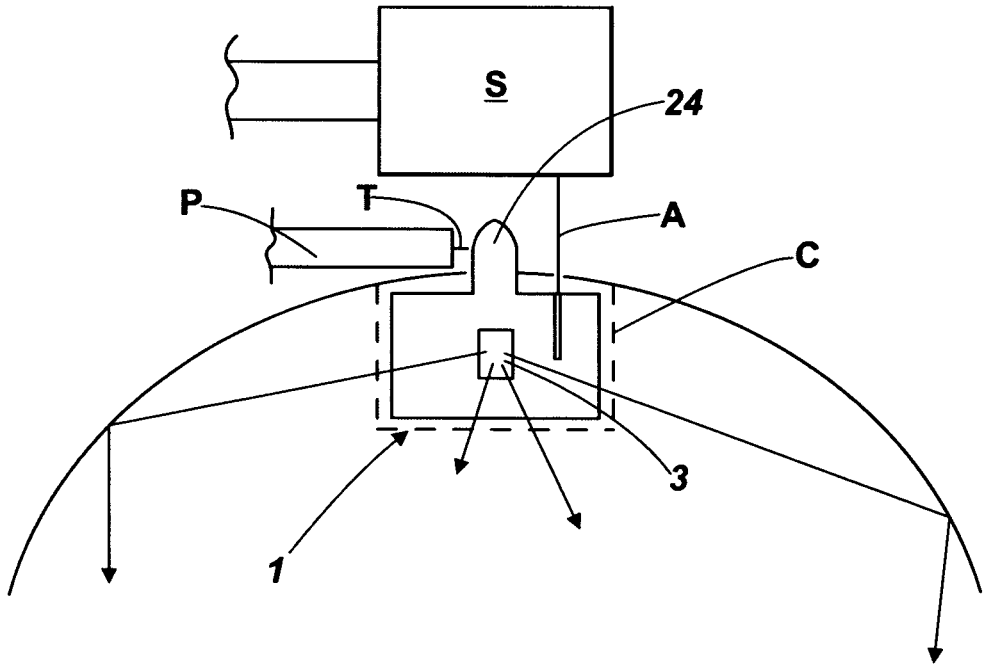
FIG. 6 is a schematic view of the filled plasma crucible of FIG. 1 in use.

FIG. 6 shows this filled plasma crucible installed for use with a Faraday cage C surrounding it and an antenna A extending into the antenna re-entrant 11 to introduce microwaves from a source S of them. For starting a plasma discharge in the void, a starter probe P is arranged with its tip T adjacent the vestigial stub 24 of the tube between the tip off 23 and the back end of the crucible.

Figure 7:
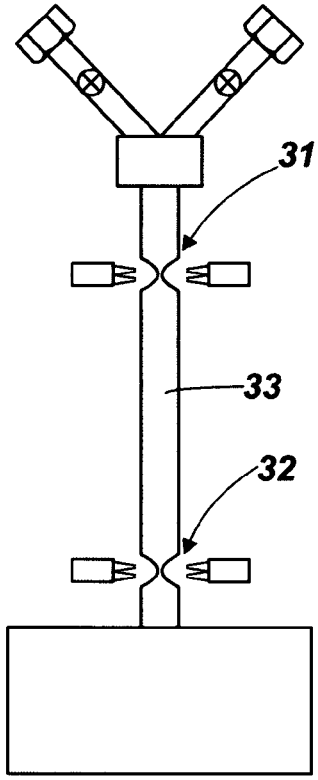
FIG. 7 is a view similar to FIG. 4 showing an alternative manner of heating the tube for sealing of the crucible.
Figure 4:
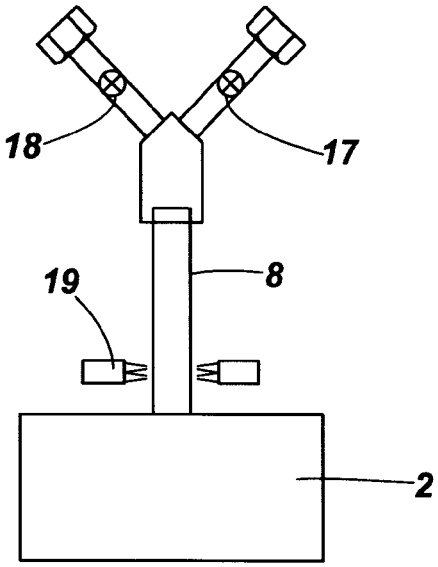
FIG. 4 is a similar view of the tube being heated for sealing of the crucible.
Figure 5:
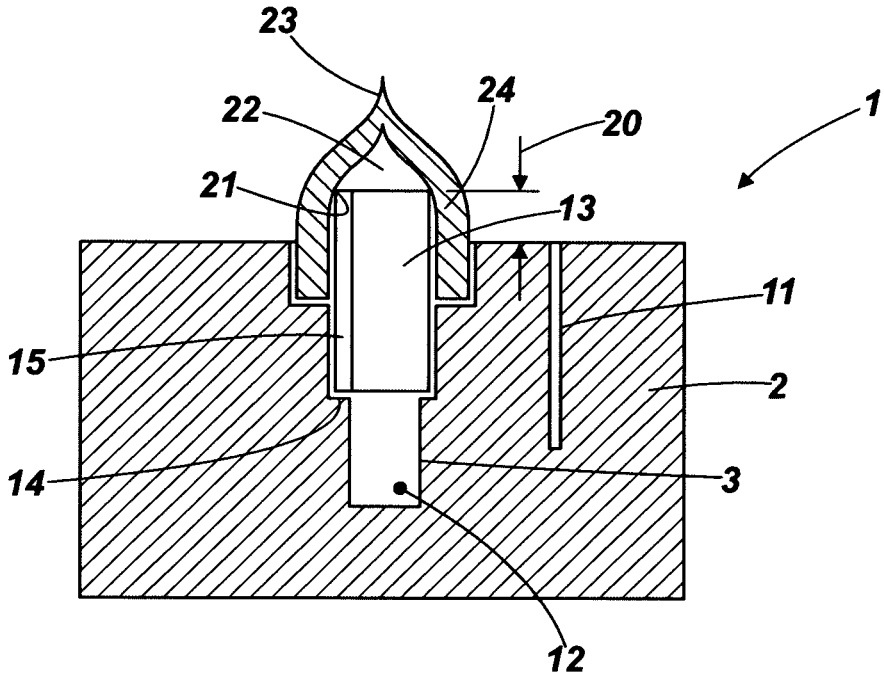
FIG. 5 is a cross-sectional side view similar to FIG. 2 of the filled plasma crucible sealed in accordance with the invention.

In the variant shown in FIG. 7, the tube is longer and is initially sealed and tipped off at a position 31 remote from the crucible as such, to captivate the noble gas and the excitable material in the device, in like manner to that of our earlier bulb sealing patent No. EP 1,831,916. The device can now be manipulated freely from the Y fitting. The tube is then sealed and tipped off at 32 as described above at the plug. This arrangement allows ready manipulation of the intermediate length 33 of tube to be discarded, in turn allowing for uniformly repetitive production.

Figure 8:
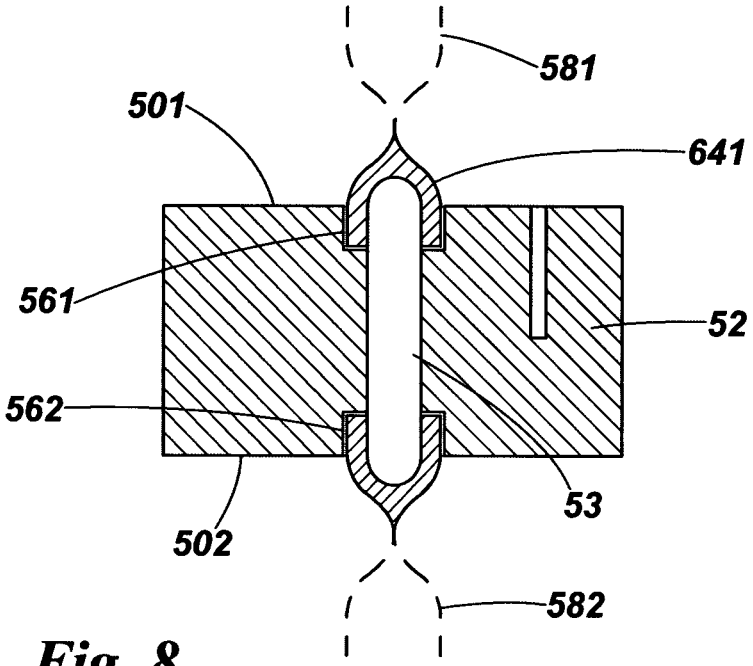
FIG. 8 is a view similar to FIG. 5 of a variant of the filled plasma crucible sealed in accordance with the invention.

A further variant is shown in FIG. 8, in which the void 53 is initially formed as a through bore from end face 501 to end face 502 of the crucible cylinder 52. The bore is formed with single counterbores 561,562 at both faces. Prior to sealing, the void is ultrasonically cleaned and then flame polished, to remove any drilling debris that might otherwise interfere with the plasma discharge in use, to remove crack propagation sites and to improve transparency. After polishing, a tube 581,582 is sealed into each bore. The one tube 581 is sealed and tipped off to leave a vestigial stub 641. The other is also sealed, after introduction of the excitable material and noble gas as described above. This variant can provide a cold spot at the outer vestigial stub of the crucible in use, that is at the end from which light collected for use. This end is expected to run cooler than the other end, which will have its vestigial stub in a casing, not shown, and the details of which are likely to vary with use of the crucible.

Figure 9:
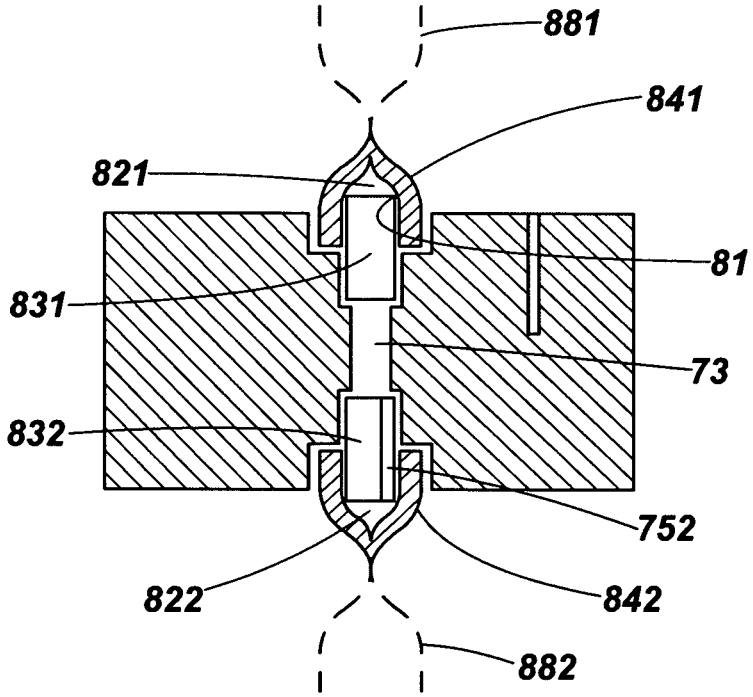
FIG. 9 is a view similar to FIG. 5 of another variant of the filled plasma crucible sealed in accordance with the invention.

Another variant is shown in FIG. 9. In this, the two ends of the void 73 are both closed by plugs 831,832 and the vestiges 841,842 of tubes 881,882. This arrangement has advantage over that of FIG. 8, in allowing protection of the crucible/tube and tube tip-off seals from direct contact with the gas in the void, which supports the plasma centrally of the void. It should be noted that this variant has two spaces 821,822 on the ends of the plugs remote from the void. Whilst the tube will be sealed with a view to a hermetic seal forming at the corners 81 of the plugs, it can be expected that this seal may not be hermetic, allowing excitable material to condense into the spaces. Therefore, for maximum performance, the excitable material is preferably provided in sufficient excess as to be able to fill these spaces fully and indeed the groove 752 in the plug via which the noble gas is introduced, the other groove is un-grooved, since no gas is introduced via it.

The invention is not intended to be restricted to the details of the above described embodiments. For instance, the stepped counter bore and circular cylindrical plug can be replaced by a complementarily tapered bore and plug. Further it is expected to be possible to seal the tube to crucible without the counter-bore 6 by performing this sealing operation in a lathe.

Figure 10:
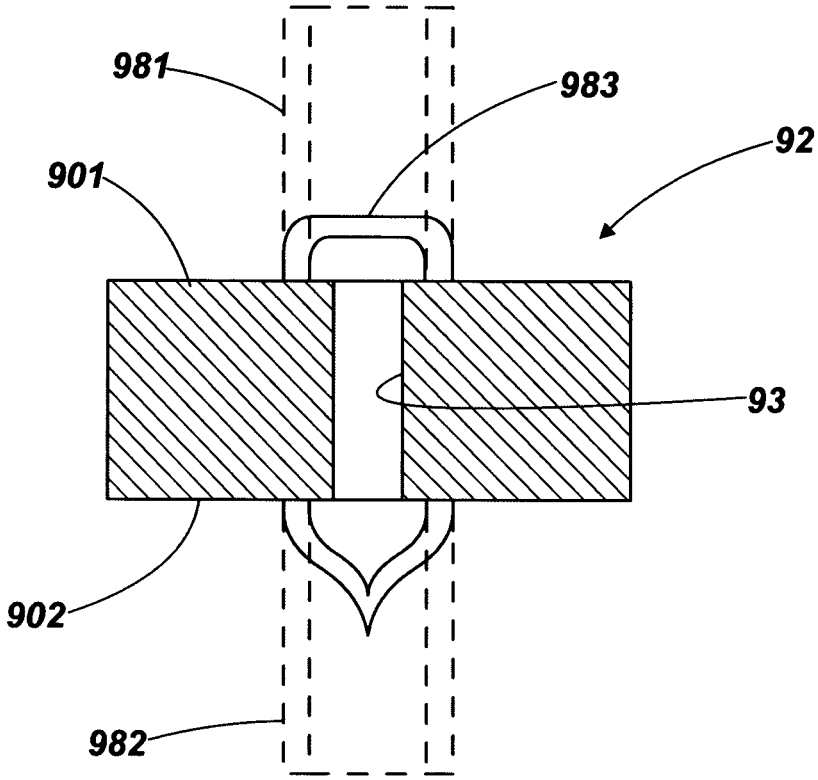
FIG. 10 is a view similar to FIG. 5 of yet another variant of the filled plasma crucible sealed in accordance with the invention.

Such a plasma crucible 92 is shown in FIG. 10. It has a through bore 93 and two tubes 981,982 initially butt sealed on to the end faces 901,902 of the crucible. One 981 of the tubes is closed prior to the filling of the crucible. Since there is no differential pressure across the tube as it is tipped off, it can be worked in a glass lathe to form it to have a flat end 983. This allows the plasma void to be of well defined dimension at this side. Due to tolerances and availability of standard tube, it is anticipated that internal diameter of the tubes 901,902 is likely to slightly exceed that of the bore 93. After evacuation, dosing and gas fill, the other tube 902 is tipped off in the similar manner, although less working to close dimensions is advisable. In use the flat end 983 is likely to be outermost, possibly covered by a Faraday cage (not shown) and exposed to the ambient environment. The other tipped off end is likely to covered by a supporting structure (also not shown). In addition to a flat end 983, we have successfully tested a hemispherical end.

In a further alternative, in contrast to a through-bored crucible, which can be treated as mentioned above for removal of micro-cracks, or indeed a section of thick wall tube, it is possible for applications where product life is not a primary concern, to bore the void from one side a piece to quartz. Again it can be envisaged that the crucible might be formed of sintered material. In such instances, a single tube only can be butt sealed around the mouth of the void and sealed in the manner described.

Typically in use of a quartz crucible operating at 2.4 GHz, the crucible can be circularly cylindrical with a diameter of 49 mm and a thickness of 21 mm. The diameter of the void is not thought to be critical and can vary between 1 mm for low power and 10 mm for high power. We have used sealing tube having wall thicknesses between 1 mm and 3 mm. We have also tested crucibles with tipped off tubes up to 30 mm in length from the face of the crucible. We prefer the internal length of the tipped off tube back to the face to be between zero and 10 mm. The preferred distance is 5 mm. Provision of such a length of tube is envisaged to be useful in holding the crucible in subsequent processing and/or use thereof.

The invention claimed is:

1. A method of sealing a filled plasma crucible comprising the steps of:

providing a plasma crucible of lucent material having a through bore;

hermetically sealing a preliminary tube to the crucible in communication with one end of the through bore, sealing the preliminary tube to leave an open void, the void having a mouth;

providing a further tube of material fusible to the lucent material extending away from the mouth of the crucible and hermetically sealing the tube to the crucible in communication with the void;

inserting excitable material in to the void via the tube;

evacuating the void via the tube;

introducing an inert gas into the void via the tube; and sealing the void, enclosing the excitable material and the inert gas, by sealing the tube at or close to the mouth.

2. A sealing method as claimed in claim 1, wherein the sealing step includes collapse and fusing of the further tube.

3. A sealing method as claimed in claim 2, wherein the further tube is positioned on and fused onto a face of the crucible.

4. A sealing method as claimed in claim 2, wherein the further tube is positioned in and fused into a counterbore in the face of the crucible at the mouth of the void.

5. A sealing method as claimed in claim 1, further comprising the step of positioning a plug of material fusible to the lucent material at the mouth and wherein the sealing step includes fusing the plug to the crucible.

6. A sealing method as claimed in claim 5, wherein the plug is positioned on and fused onto a face of the crucible.

7. A sealing method as claimed in claim 5, where in the plug is positioned in and fused into a counterbore in the face of the crucible at the mouth of the void, the plug and the mouth being complementarily shaped for location of the plug for its sealing in the mouth and provided with clearance and/or local shaping to allow gas flow from and to the void.

8. A sealing method as claimed in claim 5, wherein the further tube and the plug where provided are of the same lucent material as the crucible.

9. A sealing method as claimed in claim 1, wherein the lucent crucible material is quartz.

10. A filled plasma crucible sealed in accordance with the method of claim 1, the crucible having:

a tube or a vestige thereof extending from a sealed mouth of the crucible.

11. A filled plasma crucible as claimed in claim 10 having:

a tube or a vestige thereof extending from a sealed mouth of the crucible at both ends thereof.

12. A sealing method as claimed in claim 1, including a preliminary step of ultrasonic cleaning and flame polishing of the bore.

13. A sealing method as claimed in claim 1, wherein the seal is formed so as to create an end to the void flush with a face of the crucible onto which the further tube is sealed.

14. A sealing method as claimed in claim 1, wherein the seal is formed so as to create a part of the void extending beyond a face of the crucible onto which the tube is sealed, whereby a cool spot for the fill of the void is provided.

15. A sealing method as claimed in claim 1, further comprising the step of separating a portion of the tube remote from the crucible at its seal.

16. A sealing method as claimed in claim 1, not including the step of separating any portion of the or each tube remote from the crucible at its seal.

17. A sealing method as claimed in claim 1, where in the lucent crucible material is polycrystalline ceramic.

18. A method of sealing a filled plasma crucible comprising the steps of:

providing a plasma crucible of lucent material having an open void, the void having a mouth;

providing a tube of material fusible to the lucent material extending away from the mouth of the crucible and hermetically sealing the tube to the crucible in communication with the void;

inserting excitable material in to the void via the tube;

evacuating the void via the tube;

introducing an inert gas into the void via the tube; and, sealing the void, enclosing the excitable material and the inert gas, by sealing the tube at or close to the mouth; and, positioning a plug of material fusible to the lucent material at the mouth and wherein the sealing step includes fusing the plug to the crucible.

19. A sealing method as claimed in claim 18, wherein the plug is positioned on and fused onto a face of the crucible.

20. A sealing method as claimed in claim 18, wherein the plug is positioned in and fused into a counterbore in the face of the crucible at the mouth of the void, the plug and the mouth being complementarily shaped for location of the plug for its sealing in the mouth and provided with clearance and/or local shaping to allow gas flow from and to the void.

* * * * *